United States Patent [19]

Wilkinson et al.

[11] Patent Number: 4,790,705

[45] Date of Patent: Dec. 13, 1988

[54] METHOD OF FORMING A BUCKLE RESISTANT CAN END

[75] Inventors: Harlen E. Wilkinson, Crystal Lake; Neal E. Langseder, Rolling Meadows, both of Ill.

[73] Assignee: American National Can Company, Chicago, Ill.

[21] Appl. No.: 13,599

[22] Filed: Feb. 11, 1987

Related U.S. Application Data

[60] Division of Ser. No. 307,209, Sep. 30, 1981, abandoned, which is a continuation-in-part of Ser. No. 112,569, Jan. 16, 1980, abandoned.

[51] Int. Cl.[4] ..... B21D 51/44

[52] U.S. Cl. ..... 413/8; 413/56

[58] Field of Search ..... 413/8, 56, 62; 72/347, 72/348, 350, 351

[56] References Cited

U.S. PATENT DOCUMENTS

| | | | |
|---|---|---|---|
| 3,441,170 | 4/1969 | Khoury | 220/66 |
| 3,580,464 | 5/1971 | Griffith | 220/67 |
| 3,774,801 | 11/1973 | Gedde | 220/66 |
| 3,843,014 | 10/1974 | Cospen et al. | 220/66 |
| 4,031,837 | 6/1977 | Jordan | 413/8 |
| 4,163,504 | 8/1979 | Elser | 220/67 |
| 4,567,746 | 2/1986 | Bachmann et al. | 72/348 |

*Primary Examiner*—Frederick R. Schmidt
*Assistant Examiner*—Robert Showalter
*Attorney, Agent, or Firm*—Robert A. Stenzel; Ralph R. Rath

[57] ABSTRACT

A buckle resistant end for containers which is formed with an inwardly bowed countersink wall, a countersink groove defined by two unequal radii and a central panel wall stretched taut by accentuated doming.

1 Claim, 5 Drawing Sheets

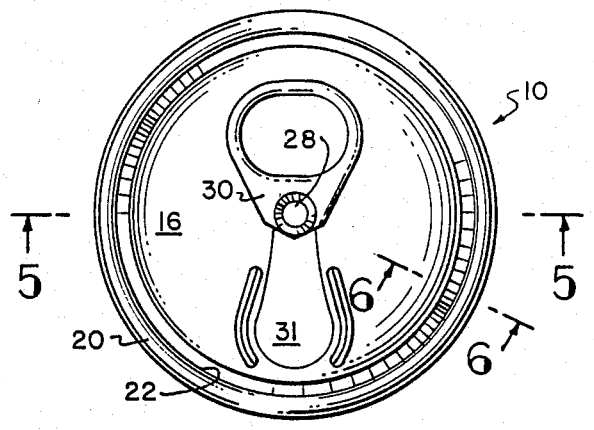
FIG. 1
FIG. 2
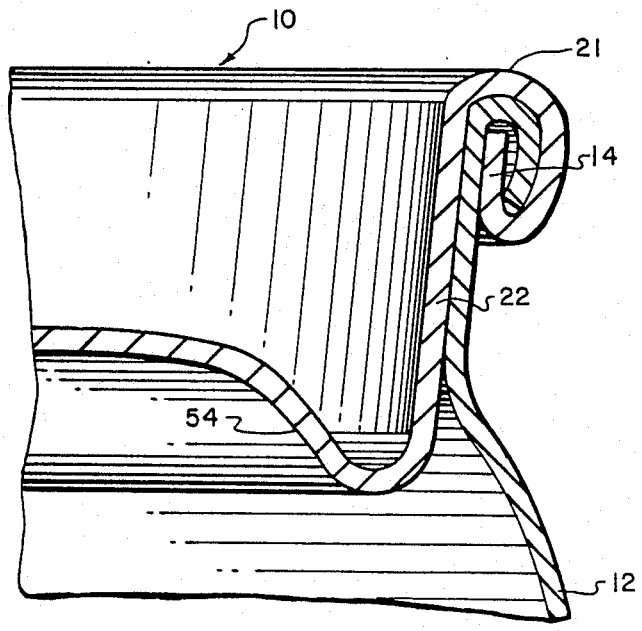

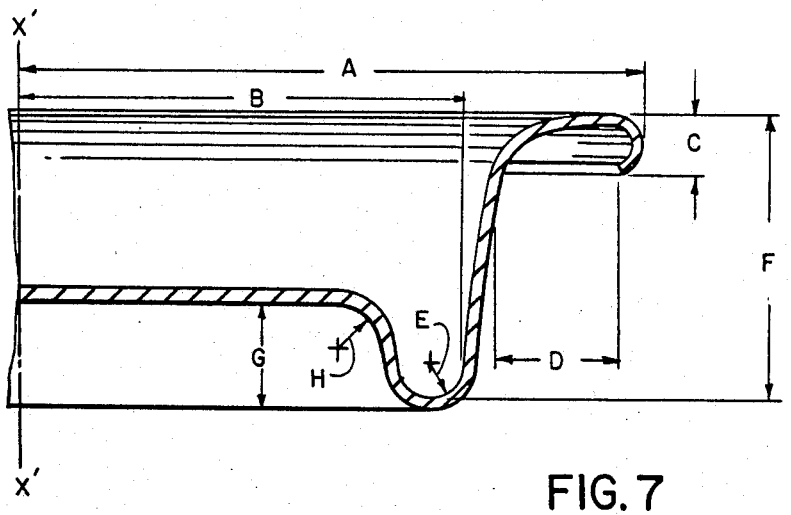
FIG. 7
FIG. 8
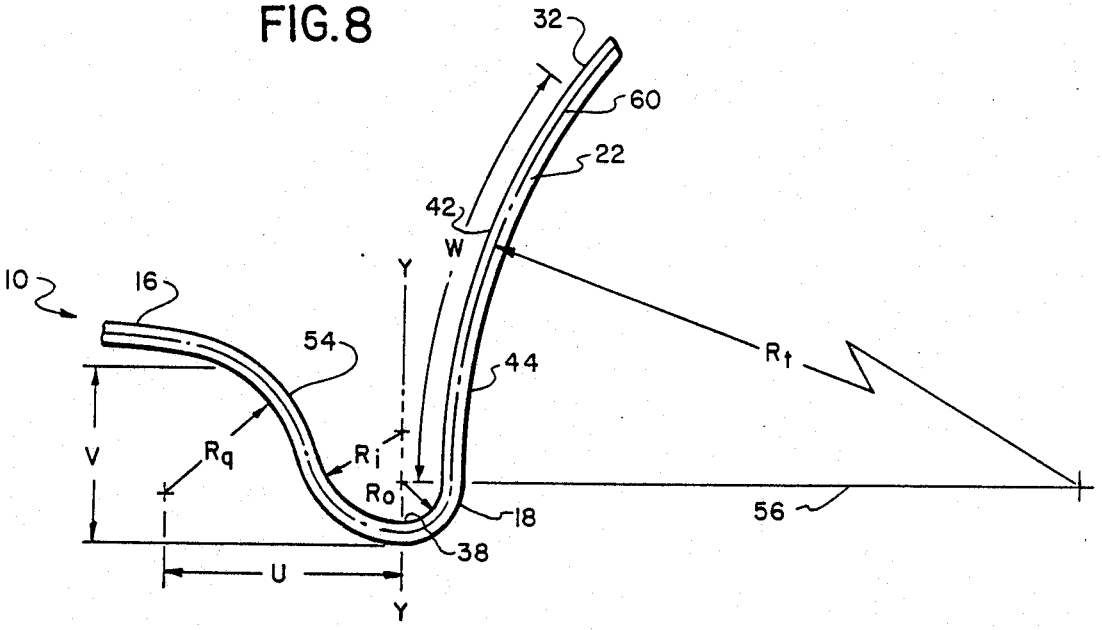

METHOD OF FORMING A BUCKLE RESISTANT CAN END

This is a Division of application Ser. No. 307,209, filed Sept. 30, 1981, now abandoned which is a continuation in-part of Ser. No. 112,569 filed Jan. 16, 1980 now abandoned.

BACKGROUND OF THE INVENTION

This invention relates to an improved end for rigid containers. More particularly it relates to an end which has been designed to provide superior buckling resistance from internal pressure.

Buckling is a condition which results when the internal forces within the can exceed the strength of the end thereby causing a portion of the end panel including the countersink wall to bulge upwardly. The resulting bulge may interfere with can stacking, functioning of the easy open features including rupture of the score line, or even cause failure of the double seam. While a possible solution to the buckling problem is to increase the gauge of the end stock, the high volume of production in the container industry makes even a modest increase in material usage undesirable. While considerable effort has been directed to the improvement of end design, if the improvements are to be commercially acceptable they must be compatible with the constraints and standards established by the practitioners of the art. The United States Brewers Association has established standards for Flush Panel and Ring Pull Aluminum Ends which are employed as closures for seamless aluminum cans. These standards, which define the critical dimensions of the ends are listed in Table 1 which is taken from the USBA specification dated 9-1-77. FIG. 7, also taken from the USBA specification, defines the location of these dimensions on the end.

Three dimensions in Table 1 are of particular interest, item B the countersink diameter, item E the countersink radius and item F the counter-sink depth. These dimensions ensure that the seaming chuck will properly enter the countersink area and engage the end to effect end rotation during seaming.

Two additional dimensions item G panel height and item H panel radius are also of interest although it should be noted that these items have been deleted from the most recent USBA standards.

TABLE I (Refer to FIG. 7)
USBA DIMENSIONS
FLUSH PANEL AND RING PULL ALUMINUM ENDS
SEAMLESS ALUMINUM CANS

| Dimension Key | 206 Diameter | 207.5 Diameter | 209 Diameter | 211 Diameter |
|---|---|---|---|---|
| A. Curl Diameter | 2.614 ± .010 | 2.730 ± .010 | 2.840 ± .010 | 2.945 ± .010 |
| B. Countersink Diameter (Die Dimension) | 2.150 Ref. | 2.256 Ref. | 2.356 Ref. | 2.475 Ref. |
| C. Curl Height-Ends/2 Inches | 21 ± 2 | 21 ± 2 | 21 ± 2 | 21 ± 2 |
| Individual End Measurement | 0.090/0.105 | 0.090/0.105 | 0.090/0.105 | 0.090/0.105 |
| D. Curl Opening | .121 Min. | .121 Min. | .121 Min. | .121 Min. |
| E. Countersink Radius | .030 ± .005 | .030 ± .005 | .030 ± .005 | .030 ± .005 |
| F. Countersink Depth | .250 ± .005 | .252 ± .005 | .253 ± .005 | .253 ± .005 |
| G. Panel Height (2) | .066 ± .004 | .066 ± .004 | .066 ± .004 | .066 ± .004 |
| H. Panel Radius (3) | .030 ± .005 | .030 ± .005 | .030 ± .005 | .030 ± .005 |

(1) United States Brewers Association - September 1, 1977
(2) In the standards dated 2-27-81 this dimension is limited to a tolerance.
(3) In the standards dated 2-27-81 this dimension has been deleted.

A recent U.S. Pat. No. 4,031,837 discloses a method for reforming ends to improve buckle resistance. A basic end is reformed to decrease the radius of curvature of the countersink groove from the standard 0.030"

to 0.020" with a 0.024" increase in groove depth. The reforming process reportedly increased buckle resistance from 89 PSI to 105 PSI.

Also of interest is U.S. Pat. No. 3,843,014 which discloses a deep countersink groove with a radius of curvature which varies between 0.020" and 0.047" and where the included angle between the walls of the countersink groove may vary between 7° and 34° with relatively little loss of buckle resistance. The depth of the countersink groove is substantially greater than the limits set by USBA so that such an end is incompatible with the existing equipment.

U.S. Pat. No. 3,774,801 relates to a buckle resistant can end which is formed with a diagonal sloping inner wall re-enforced with at least two peripheral radially separated concave areas of curvature. The end is predomed but no details regarding conformance to USBA standards are disclosed in the patent.

Finally, U.S. Pat. No. 3,441,170 is also of interest in that it discloses a method to control rather than resist buckling. The panel radius, which joins the central panel wall with the inner wall of the countersink groove is coined. The coining increases the excess metal available for bulging and also reportedly enables the radius to act as a hinge so that the buckling occurs but in a controlled manner.

It is an object of this invention to provide a can end which is strengthened to resist buckling but which is compatible with the industry standards.

Another object of this invention is to provide an end which is sufficiently strengthened to permit a reduction in the gage of the end stock.

A further object of this invention is to provide an improved end which will permit higher pasturization temperatures thereby enabling production lines to operate at higher speeds.

Finally, it is an object of this invention to provide an improved can end which may be readily manufactured with only minor changes in existing equipment.

SUMMARY OF THE INVENTION

It may be seen that the aforementioned objects of the invention may be attained in an end closure for a container which includes a central panel which extends laterally outward from a central longitudinal axis of rotation with downwardly directed periphery which merges into an upwardly facing countersink groove having a lower-most central portion. The outer extremity of the groove merges into an upwardly and outwardly extending countersink wall and terminal peripheral flange. In the instant invention, enhanced buckle resistance is achieved by forming the countersink groove with inner and outer arcuate wall portions which merge respectively with the central panel wall and the countersink wall.

The arcuate wall portions extend to the lower-most central portion of the countersink groove where they merge together at the root of the groove.

The outer arcuate groove is formed with a pre-determined radius of curvature, the origin of which is located on an axis normal to the countersink groove at the root. The normal axis is parallel to the central longitudinal axis of rotation of the end.

The inner arcuate groove wall portion has a predetermined radius of curvature which is substantially greater than the outer portion radius. The origin of the inner portion radius is located on the normal axis, but further from the root than the origin of outer radius portion.

The countersink wall of the instant invention defines a continuous curve between the groove and the flange to place the inner surface of the countersink wall in tension and the outer surface in compression when the closure is secured to the container body by the flange.

The inner radius of curvature is advantageously substantially twice that of the outer radius of curvature.

The inner radius is about 0.035" to 0.045", and the outer radius is about 0.020" to 0.025.

The periphery of the central panel is advantageously formed with a reversely curved wall portion such that the end closure from the periphery of the central panel to the terminal flange is defined by a continuous curve.

The central panel is preferably domed and stretched beyond its yield point to define a taut profile stable upwardly domed configuration with a radius of curvature greater than the reversely curved peripheral portion.

The central panel is preferably domed with a radius of curvature of between 4.0" and 4.5" the origin of which is located on the longitudinal axis.

BRIEF DESCRIPTION OF THE DRAWINGS

FIG. 1 is a top plan view of a can end prior to its attachment to a can body.

FIG. 2 is a detailed sectional view of a can end fragment embodying the present invention and seamed to a can body.

FIG. 7 is a sectional view of a domed can end showing the standard dimensions as defined by the USBA and as enumerated in Table I.

FIG. 8 is a greatly enlarged section of the countersink groove of FIG. 6.

DETAILED DESCRIPTION OF THE ILLUSTRATED EMBODIMENT

Figure 3:
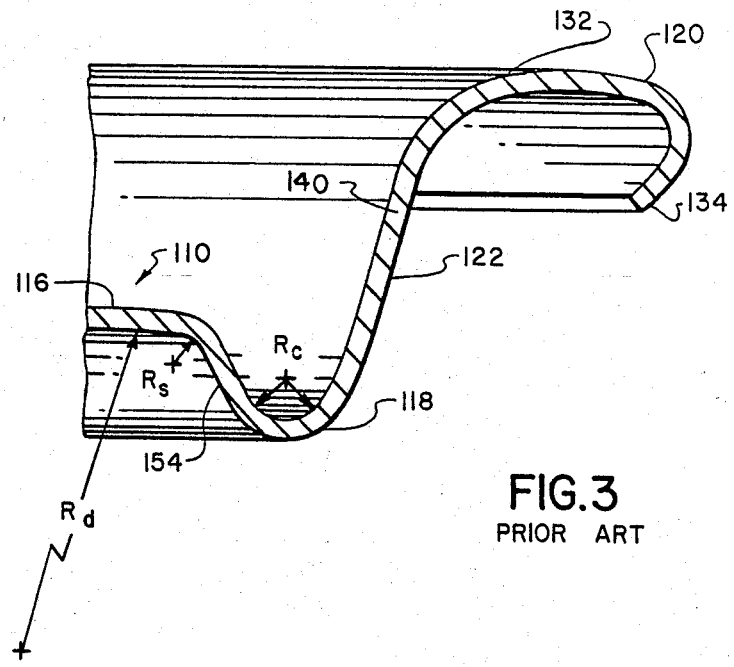
FIG.3 PRIOR ART
FIG. 3 is a detailed sectional view of the unseamed prior art can end fragment.

Turning now in detail to FIG. 1 of the appended drawings therein illustrated is a top plan view of a free unseamed can end 10 including a central panel wall 16, a countersink groove 18, a flange 20 and a countersink wall 22. The central panel wall is formed into an integral rivet 28 which stakes opening tab 30 to tear strip 31.

Figure 5:
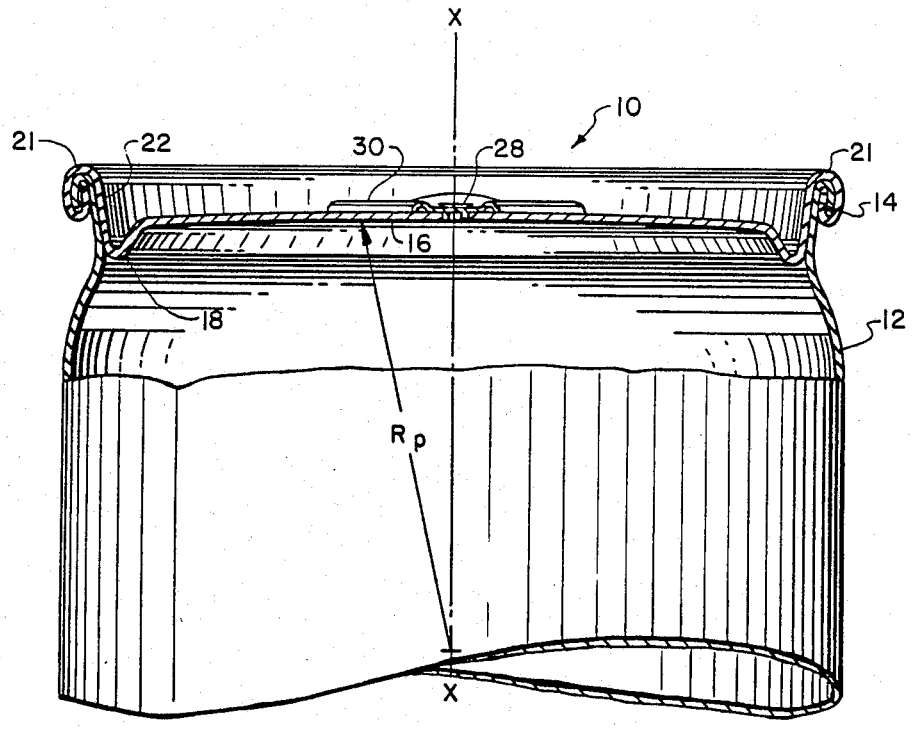
FIG. 5 is a sectional view of a domed can end embodying the present invention.

FIG. 2 is an enlarged view of a portion of the end of FIG. 5 taken in the area of the countersink groove.

FIG. 3 shows in detail a portion of the free unseamed prior art container end 110 which conforms to the standards of the USBA. The end is provided with a central panel wall 116 outward of which is a countersink groove 118. The flange 120 lies outward of the groove with an incurve 132 and a curled lip 134.

The central panel wall is predomed according to conventional practice with a doming radius $R_d$, with the origin of the radius on the axis of rotation of the end. The doming radius is not defined by the USBA.

The countersink wall 122 merges the flange incurve with the countersink groove.

It should be noted that the countersink wall is bowed inwardly at its upper extremity where it merges with the incurve and outwardly at its lower extremity where it joins the countersink groove. A point of inflection 140 occurs proximate the midpoint between the flange and the groove. The countersink diameter, item B extends from the point where the countersink wall on one side of the end to the corresponding point on the other side of the end. This serves as a reference.

The countersink groove 118 is defined by the countersink diameter, the countersink radius and the countersink depth. The countersink radius $R_c$ (item E of Table I) is nominally 0.030". Since the groove width is nominally 0.060" the origin of radius of curvature $R_c$ is 0.030" above the root and 0.030" inward of the extremity of the countersink diameter. The tolerance specified for the countersink radius is ±0.005".

The inner wall 154 of the countersink groove joins the central panel wall 116 with the root 138 of the countersink groove. A downwardly directed panel radius $R_s$ defined in the USBA standards dated Sept. 1, 1977 as item H=0.030 ±0.005 is disposed around the periphery of the central panel wall. The origin of the panel radius is disposed inward of the extremity of the countersink diameter reference by a distance equal to about $2\times R_c+t+R_s$ (where t is stock thickness) and 0.030" below the upper extremity of the panel height.

Figure 4:
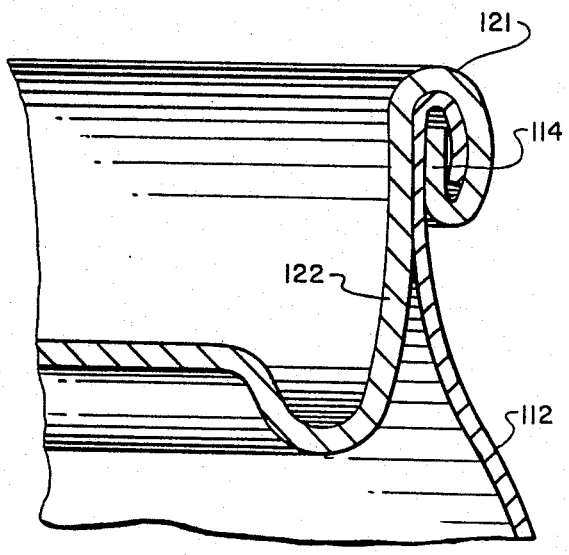
FIG.4 PRIOR ART
FIG. 4 is a detailed sectional view of the prior art can end fragment seamed to a can body.

FIG. 4 is a fragmentary section showing the prior art end joined to the wall of a filled container. Countersink wall 122 remains bowed outwardly along its lower portion.

FIGS. 2, 5, 6 and 8 deal exclusively with the present invention.

FIG. 5 is a sectional view of the domed buckle resistant end 10 taken along the line 5—5 of FIG. 1, and joined to the wall of a tubular container body 12 by means of a double seam 14. The central panel wall 16 which is prominently domed upwardly with a doming radius of curvature $R_p$ is surrounded by a countersink groove 18 which in turn is joined to the rim 21 of the flange by the countersink wall 22. The end is formed into an integral rivet 28 which stakes the opening tab 30 to a displaceable portion 31 in the end panel.

Figure 6:
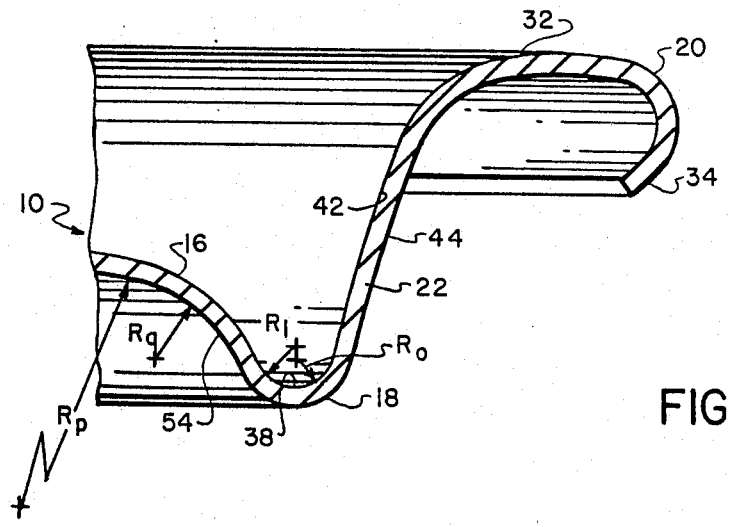
FIG. 6 is a detailed sectional view of the unseamed can end fragment embodying the present invention taken along the line 6—6 of FIG. 1.

In FIG. 6 the preferred embodiment is shown in detail prior to seaming. The container end 10 has a flange 20 with an outer lip 34 and an incurve portion 32. The countersink wall 22 is bowed inwardly along its entire length from its mergence with the incurve portion 32 of the flange to the point where it joins the countersink groove 18. The inwardly bowed countersink wall is characterized by an inner surface 42 which is in tension and an outer surface 44 which is in compression.

Figure 6A:
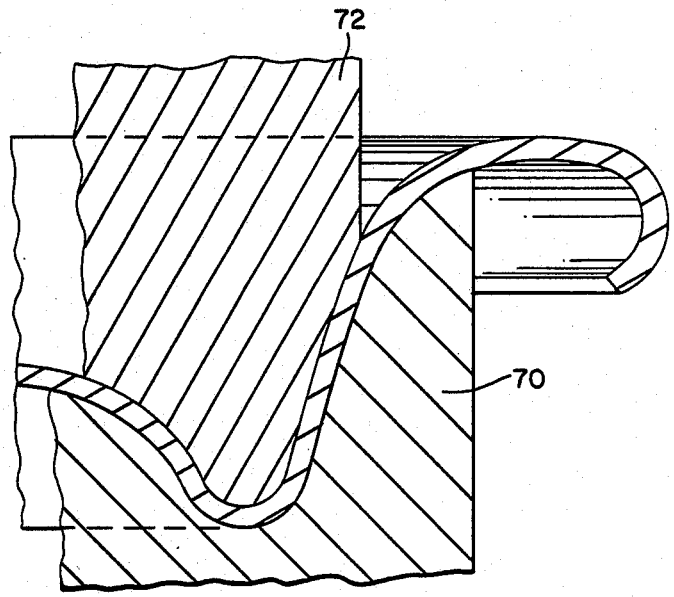

FIG. 6A is a fragmentary cross-sectional view showing the tooling used for reforming the end.

The countersink groove 18 is upwardly facing with a root 38 an outer arcuate wall portion defined by a radius of curvature $R_O$ and which joins the root with the countersink wall. The countersink groove has an inner arcuate wall portion defined by a radius of curvature $R_i$ which joins the groove root, or lowermost portion with a reversely curved inner wall portion 54 disposed about the periphery of the central panel 16. This reversely curved inner wall is defined by a panel radius $R_q$ to form with the groove and countersink wall a continuously curved end closure between the central panel and the terminal flange.

Radii $R_o$ and $R_i$ are unequal with $R_o$ being approximately one half of $R_i$. $R_o$ may range between 0.020" and 0.025" but is preferably about 0.020". $R_i$ should be maintained at about 0.040"±0.005". $R_i + R_o$ should fall within the USBA standards which establish the groove width at 0.050" to 0.070".

The origins of radii $R_o$ and $R_i$ fall on a common axis drawn normal to the countersink groove at the lowermost portion or root 38. This normal axis y—y is parallel to the central longitudinal axis of rotation of the end. The origin of $R_i$ is necessarily further from the root than $R_o$ being approximately twice the distance. USBA reference dimensions B and F (countersink diameter and countersink depth) define the specific location of these radii with respect to the end. The resulting groove is assymetric to the normal axis y—y.

In FIG. 8, the area of the countersink groove has been greatly enlarged to show the structure in greater detail.

The countersink wall 22 is shown bowed inwardly from its point of tangency with the incurve of the flange to its point of tangency with the outer wall of the groove for an angular displacement of W=25.69°. The radius of curvature $R_t$ of the bowed wall is 0.39" from the neutral axis 60 of the metal stock to the origin which is located on the $R_o$ plane 56.

The panel radius $R_q$ is disposed around the periphery of the central panel wall. The panel radius $R_q$ may vary from 0.030" to 0.050" but is preferably about 0.050". The panel radius in FIG. 8 is shown at 0.050" tangent to the central panel at its periphery and also tangent to the inner wall of the countersink groove. The origin of the panel radius is 0.050" below the periphery of the central panel wall and inward of the y—y normal axis by a distance of U=to about 0.096".

The central panel wall which extends laterally outward from a central longitudinal axis of rotation x—x is prominently domed with a radius $R_p$ which is substantially less than the conventional doming radius $R_d$. The origin of this radius is located on the axis of rotation of the end x—x of FIG. 5. The reduced radius of curvature results in an end panel which is stretched beyond its yield point to form a taut wall profile-stable upwardly domed configuration. The metal is stretched sufficiently to resist any tendency toward "oil canning" or "snap buckling" which is characteristic of conventionally domed ends. This phenomenon is observed when a metal is in a bistable stage wherein pressure, as might be exerted by ones fingers on an unseamed end, causes the wall to deflect from a first position across a neutral plane to a second position. This deflection is generally accompanied by an audible click. The phenomenon is commonly observed with the walls of a conventional oil can. Further the strectched metal resists additional deflection when it is seamed to a container wall and subjected to internal pressure from the contents of the container. When the prominently domed end is seamed to a container body, the inward bowing of the countersink wall is substantially removed by the seaming thereby resulting in a straightened countersink wall as shown in FIG. 7. This straightened countersink wall resists internal pressure by axial compression. It should be noted, that despite the increase in dome height which the reduced doming radius $R_p$ imposes on the free unseamed end, substantial internal pressures do not cause the tab 30 to protrude above the rim of the seamed container. In fact the end which is stretched by 1.2% a a result of the pronounced doming is substantially more resistant to deflection by internal pressure than is a conventionally domed end. End deflection tests at 70 PSI which were conducted to compare the deflection of the central panel wall of conventionally domed ends, as typified by prior art end 110, with the improved end 10 showed an upward deflection of end 110 of 0.075" in comparison with 0.035" for the improved end 10.

Crush strength was also enhanced significantly by the pronounced doming. In tests where the end was collapsed by compressive loading the prior art end exhibited failure at an average load of 18.92 PSI whereas the improved end did not exhibit failure until an average load of 39.13 PSI was imposed.

To further illustrate the advantage of the instant structure, 207.5 diameter ends were fabricated of 0.0125 5182 H19 aluminum alloy plate. Basic ends were blanked and drawn to a basic end profile in a strip feed press, in a conventional manner. The basic end profile included the flange, countersink wall and countersink groove, configurations shown in the prior art profile of FIG. 3 but the central panel was planar rather than domed. The ends were divided into two groups, group A which was processed in accordance with the practice and design of the prior art, and group B which was processed in accordance with instant invention. Group A ends were converted in a 6 station conversion press to easy open ends. Doming was carried out in the last press station according to conventional practice using a spherical doming die which produced a dome of radius $R_d$=5.56" and a dome height of .170" to .174" with an average height of 0.172". Group A ends had a conventional countersink radius $R_c$=0.030±0.005", and a conventional panel radius $R_s$=0.030".

Group B ends were processed through the first five stations of the conversion press in the conventional manner but were reformed in a separate press in accordance with the instant concept. The countersink groove was reformed with the aid of a control ring 70 (FIG. 6A) which encircles the doming die. The countersink groove was engaged by both the control ring 70 and the punch 72, trapping the countersink groove therebetween and thereby reforming and setting the compound radius with the outer radius $R_o$=0.020" and the inner radius $R_i$=0.040". The control ring further engaged the countersink wall to effect the inward bowing shown in FIGS. 6 and 8. The central panel wall was domed with a doming radius $R_p$=4.0" and a panel radius $R_q$=0.0375" concurrent with the reforming of the countersink wall and groove. Group B ends had a resulting dome height of 0.205"-0.210" with an average height of 0.2079". Ends from both groups were seamed on beverage containers which were then subjected to increasing internal pressure. Both Group A and Group B ends resisted internal pressure of 70 PSIG without tab projection beyond the container rim. Group A ends however exhibited buckling at pressures ranging from a low of 92.5 PSIG to a high of 97.0 PSIG with an average pressure of 94.5 PSIG. In contrast the Group B ends did not exhibit buckling until pressures of 107 PSIG were reached. Some of the Group B ends resisted internal pressures as high as 116 PSIG without buckling. The average pressure required to effect buckling of Group B ends was 111.5 PSIG. This increase in buckle resistance would permit the use of lighter gauge stock and still ensure good resistance to buckle failure.

In further tests under actual commercial conditions 200,000 improved buckle resistant 5182 H19 aluminum ends were reformed and domed in the final station of the conversion press. These ends were evaluated in four trials against ends sampled from production which conformed with the prior art structure 110. Both the improved ends and the prior art ends were fabricated from lighter gauge stock. Table II delineates the results of these tests.

TABLE II

| PRODUCT DIMENSION | PRIOR ART | BUCKLE RESISTANT |
|---|---|---|
| A. Curl Diameter | 2.730 ± .010 | 2.730 ± .010 |
| B. Countersink Diameter | 2.256 | 2.256 |
| C. Curl Height | .090–.105 | .094 ± .006 |
| D. Curl Opening | .121 Min. | .121 Min. |
| E. Countersink Radius | | |
| outside | .030 ± .005 | .020 |
| inside | .030 ± .005 | .040 |
| F. Countersink Depth | .252 ± .005 | .252 ± .005 |
| G. Panel Height | .066 ± .004 | .066 ± .004 |
| H. Panel Radius | .030 ± .005 | .050 |
| Trial #1 | | |
| Stock Thickness | .0119–.0123 | .0119–.0121 |
| Buckle Resistance | 94.9 (92–97) | 105 lbs. (103–108) |
| Trial #2 | | |
| Stock Thickness | .0120 (Nominal) | .0120 (Nominal) |
| Buckle Resistance | 99.6 | 103 |
| Trial #3 | | |
| Stock Thickness | .0119–.0122 | .0118–.0120 |
| Buckle Resistance | 88 (82–91) | 95.8 (92–102) |
| Trial #4 | | |
| Stock Thickness | .0120 Nominal | .0120 Nominal |
| Buckle Resistance | 88.2 (84–92) | 96.2 (92–102) |

It should be noted that unlike conventional doming practice, where the metal for the dome is pulled from the surrounding outer areas of the end; in the improved buckle resistant end 10, the metal in the outer areas is constrained by the entrapment of the metal in the countersink groove through the cooperative action of the punch and the control ring. Consequently the metal in the outer areas of the improved buckle resistant end is not free to be pulled inward during doming. The resulting dome is stretched taut.

When the end is removed from the press, the panel radius, which is formed by contact with the periphery of the doming die will open from a conventional forming dimension of 0.030" to a finished dimension, as shown in FIG. 8 of $R_q$=0.050.

As an alternative practice to the reforming of a basic end, the improved countersink wall and groove configuration of the instant invention may be incorporated in the basic end die. In such a case, outer radius $R_o$ must be increased somewhat to avoid metal fracture.

While the inventive concepts have been described by way of example with respect to a 207.5 diameter aluminum end, it should be recognized that, with appropriate modification, they are equally applicable to other sizes and materials. Thus while the 207.5 end requires a doming radius of 4.0", a 209 or 211 diameter end would permit the use of a slightly larger doming radius, between 4.0" and 4.5". On the other hand, the dimensions for $R_o$ and $R_i$ remain the same for all ends between the sizes of 207.5 and 211. For optimum buckle resistance $R_o$ should be maintained as small as possible although radii less than 0.019–0.20 are susceptible to fracture. $R_i$ must be sufficiently large to enable the countersink groove to meet the United States Beverage Association requirements, and to operate cooperatively with radius $R_q$.

Although the illustrated embodiment of the invention has been described in terms of the upper end of a container, it should be appreciated that the principles may be applied to the lower end of 3 piece containers as well.

It should also be appreciated that while this invention has been described in terms of an end for a beverage container, the concepts are applicable to other pressurized containers.

Finally it should further be appreciated that minor variations may be incorporated without departing from the spirit and scope of the invention as defined in the appended claims.

Thus it may be seen that the instant invention provides a can end for containers which affords superior resistance to buckling thereby permitting the use of lighter gauge end stock, and that this improvement may be accomplished with only minor modifications to existing equipment.

It may further be seen that this improved buckle resistant end may be employed to advantages where processing conditions require high pasturization temperatures and short process periods.

Finally, it may be seen that the instant invention provides a can end which is compatible with existing equipment and accordingly may be employed without the need for major tooling changes.

What is claimed is:

1. A method for reforming an end closure for a tubular container body to enhance the buckle resistance thereof, wherein said closure includes a central panel extending laterally from a central longitudinal axis of rotation merging downwardly at its periphery into an upwardly facing countersink groove having a lowermost central portion, the outer extremity of said groove merging into an upwardly and outwardly extending countersink wall and terminal peripheral flange comprising the steps of:

(a) engaging said upwardly facing countersink groove between a punch and a die to trap the wall of said groove therebetween, wherein said groove is reformed and set with an outer arcuate wall portion and an inner arcuate wall portion, said wall portions merging at a root, and wherein said outer arcuate wall portion has a radius of curvature of about 0.020"–0.025" and said inner arcuate wall portion has a radius of curvature of about 0.035"–0.045" and wherein the origin of said outer radius and the origin of said inner radius are both located on a common axis, said axis being normal to said countersink groove at said root;

(b) inwardly bowing said countersink wall along a continuous arc from its mergence with said flange to its mergence with said outer arcuate wall; and (c) doming said central panel to severely stretch said central panel beyond its yield point and make said central panel taut said doming being effected while said inner and outer arcuate wall portions are entrapped between said punch and said die and wherein said entrapped wall portions are constrained from being drawn inward toward said central panel as said doming is effected.

* * * * *

UNITED STATES PATENT AND TRADEMARK OFFICE

CERTIFICATE OF CORRECTION

PATENT NO. : 4,790,705

DATED : December 13, 1988

INVENTOR(S) : Harlen E. Wilkinson and Neal E. Langseder

It is certified that error appears in the above-identified patent and that said Letters Patent is hereby corrected as shown below:

Column 1, line 6, after "abandoned" insert --,--; line 7, after "1980" insert --,--; line 16, after "end" insert --,--; line 34, after "ends" insert --,--.

Column 2, line 25, after "occurs" delete "but"; line 32, delete "gage" and insert --gauge--.

Column 3, after the description of Figure 6, insert: --FIG. 6A is a view similar to FIG. 6 showing the forming tool.--

Column 6, line 2, delete "strectched" and substitute --stretched--; line 11, after "noted" delete ","; line 13, after "end" delete ","; line 15, after "fact" insert --,-- and after "1.2%" delete "a" and insert --as--; line 22, after "10" insert --and--.

UNITED STATES PATENT AND TRADEMARK OFFICE

CERTIFICATE OF CORRECTION

PATENT NO. : 4,790,705

DATED : December 13, 1988

INVENTOR(S) : Harlen E. Wilkinson and Neal E. Langseder

It is certified that error appears in the above-identified patent and that said Letters Patent is hereby corrected as shown below:

Column 7, line 6, after "contrast" insert --,--.

Column 8, line 8, after "possible" insert --,--.

Column 9, line 3, after "taut" insert --,--.

Signed and Sealed this

Sixteenth Day of May, 1989

*Attest:*

*Attesting Officer*

DONALD J. QUIGG

*Commissioner of Patents and Trademarks*